United States Patent [19]

Chesnut

[11] Patent Number: 4,509,283

[45] Date of Patent: Apr. 9, 1985

[54] CARTRIDGE CLIP

[76] Inventor: M. Gaines Chesnut, 17219 W. 57th Pl., Golden, Colo. 80401

[21] Appl. No.: 480,675

[22] Filed: Mar. 31, 1983

[51] Int. Cl.[3] ..... F41C 25/02

[52] U.S. Cl. ..... 42/50

[58] Field of Search ..... 42/50

[56] References Cited

U.S. PATENT DOCUMENTS

| | | | |
|---|---|---|---|
| 2,620,582 | 12/1952 | Stukas | 42/50 |
| 2,777,235 | 1/1957 | Hopkins | 42/50 |
| 3,087,270 | 4/1963 | Stoner | 42/50 |
| 3,577,860 | 5/1971 | Jestrabek | 42/50 |
| 4,127,954 | 12/1978 | Hausmann | 42/50 |
| 4,366,638 | 1/1983 | Ketterer et al. | 42/50 |

FOREIGN PATENT DOCUMENTS

| | | | |
|---|---|---|---|
| 635534 | 11/1963 | Belgium | 42/50 |
| 406904 | 8/1966 | Switzerland | 42/50 |

*Primary Examiner*—Charles T. Jordan

*Attorney, Agent, or Firm*—Sheridan, Ross & McIntosh

[57] ABSTRACT

A cartridge clip having coiled spring means so as to provide an equal force on the top cartridge whether there be one or more cartridges in the clip is disclosed. The coiled spring means has a width substantially equal to the width of the end wall of the cartridge clip. Cartridges are inserted into the clip so that the rim of each cartridge contacts a portion of the spring means.

12 Claims, 6 Drawing Figures

Fig. 1.
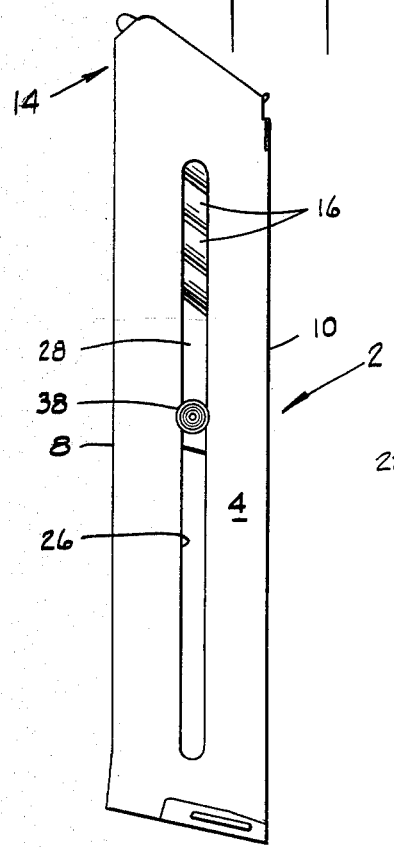
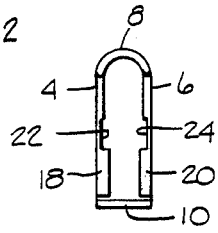
Fig. 2.
Fig. 3
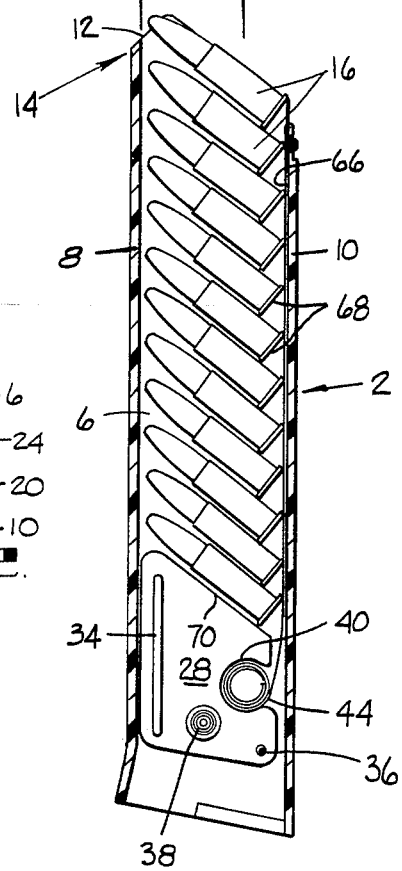
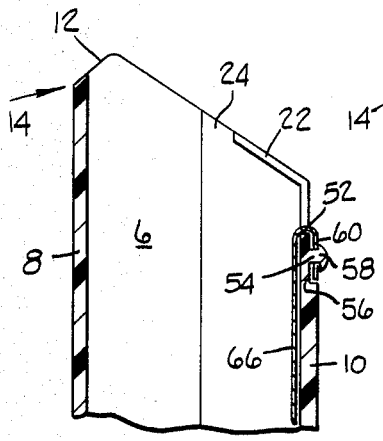
Fig. 4.
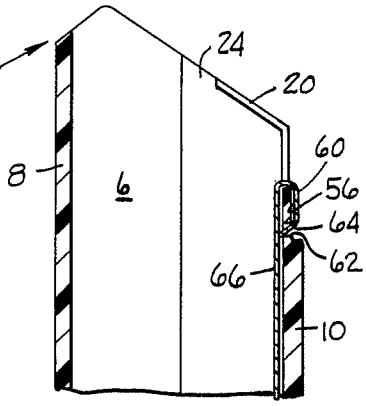
Fig. 5.
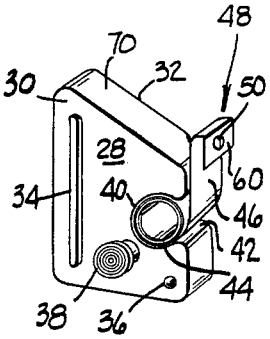
Fig. 6.

CARTRIDGE CLIP

FIELD OF THE INVENTION

This invention relates to a cartridge clip for holding ammunition for automatic feeding into a firearm and is particularly directed to a cartridge clip in which, if frictional forces are discounted, a uniform amount of force is applied to the cartridges in the clip whether the clip is fully loaded or almost spent.

BACKGROUND OF THE INVENTION

For many years the conventional cartridge case contained a helical or other type of spring that acted on a follower to move cartridges through the case of the clip. Several disadvantages were associated with this type of cartridge clip since the forces applied by the spring on the cartridges in the clip were not consistently uniform. As the cartridge clip became full there was excessive forces required to load the cartridges and as the cartridges were expended from the clip, there were times when the forces were not sufficient to move a cartridge into the firearm.

A solution to the foregoing problem was developed which solution involved the use of negator or spirally wound spring to apply a uniform force to the cartridges as they move through the clip. It is to be understood that wherever it is stated that a uniform force is applied to the cartridges, that the force involved is only that of the spring, and the frictional forces associated with the movement of each cartridge into and out of the case are not considered. Such negator springs are found in Hopkins (U.S. Pat. No. 2,777,235); Stoner (U.S. Pat. No. 3,087,270); Jestrabek (U.S. Pat. No. 3,577,860) and Hausmann (U.S. Pat. No. 4,127,954). Although these patents used negator springs, some difficulties were experienced such as the spring was associated with the sides of the cartridges; more than one spring was required; and a separate groove in the case was required.

BRIEF DESCRIPTION OF THE INVENTION

This invention involves the use of spring means that is properly dimensioned in relation to the cartridge clip so as to provide uniform movement to the cartridges as they are moved through the cartridge clip. This is accomplished by using spring means having a width substantially the same as the width of one of the end walls of the cartridge case and locating the spring means so that a portion of the rim of each cartridge in the case is in contact with a portion of the spring. In the preferred embodiment of the invention, the spring means comprises a negator spring having one end secured to one end wall of the cartridge clip and the major portion mounted in a follower that is slidably movable through the cartridge clip and wherein the negator spring has a coiled portion in the follower. Also, the coiled portion of the spring is located in an opening extending transversely through the follower with a portion of the negator spring extending out of said follower and located between said follower and said one end wall so as to provide for uniform motion of the cartridges. The invention includes means for securing the one end of the spring to the cartridge clip so that no opportunity exists for such securing means to interfere with the operation of the cartridges into and out of the cartridge clip.

It is an object of this invention to provide a cartridge clip wherein spring means are utilized to provide substantially the same amount of force on the top cartridge no matter how many cartridges are in the clip and wherein the spring means has a width substantially equal to the width of an end wall of the cartridge clip.

It is another object of this invention to provide a cartridge clip wherein the rim of each cartridge contacts a portion of the spring means.

It is a further object of this invention to provide a cartridge clip wherein one end of a spring means is secured to the cartridge clip so as not to interfere with the operation of the cartridges into or out of the cartridge clip.

The foregoing and other objects, features, and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating the principles of the invention.

BRIEF DESCRIPTION OF THE DRAWINGS

FIG. 1 is a plan view of the side of a cartridge clip of this invention;

FIG. 2 is a top plan view of the cartridge clip of this invention;

FIG. 3 is a cross-sectional view of a cartridge clip of this invention;

FIG. 4 is an enlarged view showing one means for securing one end of a spring in accordance with this invention;

FIG. 5 is an enlarged view showing another means for securing one end of a spring in accordance with this invention; and FIG. 6 is a pictorial view of a follower for use in a cartridge clip of this invention.

DETAILED DESCRIPTION OF THE INVENTION

In FIGS. 1 and 2, there is illustrated a cartridge clip comprising a case 2 having side walls 4 and 6 and end walls 8 and 10. The case 2 has an opening 12 adjacent its upper edge 14 through which cartridges 16 may be inserted into the case. Each of the side walls 4 and 6 are provided with projections 18 and 20 which function to retain the cartridges 16 in the case 2. Also, a tapering recess 22 and 24 is provided at the upper edge of each side wall so that cartridges may be inserted into and removed from the case 2. A longitudinally extending slot 26 is formed in the side wall 4 for a purpose to be described below.

A follower 28 is mounted for sliding movement in the case 2. The follower 28 has a width less than the width of the end walls 8 and 10. The surfaces 30 and 32 of the follower are provided with projections 34 and 36 which function to stabilize the follower 28 in its sliding movement through the case. The width of the follower 28 at the projections 34 and 36 is slightly less than the width of the end walls 8 and 10. The follower 28 is also provided with a knob 38 that extends through the slot 26 so that the follower 28 may be moved by a finger or thumb when desired. A hole 40 having an access opening 42 is provided in the follower 28 for a purpose to be described below.

A coiled spring 44 is positioned in the hole 40 and has one end 46 extending out of the hole 40 through the access opening 42. The end 46 has an inverted U-shaped portion 48 having an opening 50 provided therein. In the embodiment of the invention illustrated in FIGS. 3 and 4, the inverted U-shaped portion 48 is placed over an edge 52 of the end wall 10. An integral projection 54 extends from the surface 56 of the end wall 10 through the opening 50 and is provided with a head 58 having a diameter greater than the diameter of the opening 50 so as to retain one leg 60 of the inverted U-shaped portion 48 adjacent the surface 56. The head 58 is formed by applying heat to the end of the projection 54 after the inverted U-shaped portion 48 has been assembled with the leg 60 adjacent the surface 56.

FIG. 5 illustrates another embodiment of the invention. An opening 62 is formed in the side wall 10 and is spaced a short distance from the edge 52. The inverted U-shaped portion 48 is placed over the edge 52 and the end 64 of the leg 60 is bent inwardly to enter into the opening 62 and be located adjacent the extended portion 66 of the coiled spring 44 to retain the leg 60 adjacent the surface 56.

When there are not cartridges in the case 2, the follower 28 is located with the access opening 42 approximately opposite to the retaining means of FIG. 4 or 5. The case 2 is then grasped with the hand and a finger or thumb is used to push the follower 28 down into the case 2 against the force exerted by the coiled spring 44 as a portion 66 of the coiled spring 44 is moved out of the access opening 42. The rim 68 of each cartridge 16 is placed through the opening 12 at a location between the tapered recesses 22 and 24. The cartridge 16 enters into the case 2 adjacent the upper surface 70 of the follower 28 with a portion of each rim 68 in contact with an extended portion 66 of the coiled spring 44. A number of cartridges 16 are inserted into the case which in the preferred embodiment is designed to hold twelve (12) cartridges. As illustrated in FIG. 3, when fully loaded with the end 60 of the coiled spring retained adjacent the surface 56, the follower 28 is urged toward the upper edge 14 so that the back end of the top cartridge 16 is in contact with the projections 18 and 20. After loading the cartridges 16 into the case 2, the cartridge clip is inserted into a firearm. As each top cartridge 16 is moved out of the case 2 by the mechanism of the firearm, the next succeeding cartridge 16 is moved into position in contact with the projections 18 and 20. The coiled spring 44 functions to provide the same amount of force on the top cartridge whether there are one (1) or twelve (12) cartridges in the case.

While the preferred embodiments of the invention have been described herein, the invention may be otherwise embodied and practiced within the scope of the following claims.

I claim:

1. A cartridge clip comprising:

a case for storing cartridges having a pair of opposed longitudinally extending side walls and a pair of opposed longitudinally extending end walls;

each of said end walls having smooth continuous inner surfaces;

said side walls having a width greater than said end walls;

an opening adjacent the top of said case through which cartridges may be moved;

a follower mounted for movement in said case and adapted to contact the lowermost cartridge in said case;

spring means for providing a force resisting movement of said follower into said case and for urging said follower in a direction out of said case as cartridges are loaded into and moved out of said case;

said spring means comprising a negator spring with the major portion thereof mounted in said follower in a coiled relationship when no cartridges are in said case;

means for securing said negator spring at one end thereof to one of said end walls;

said negator spring having a width slightly less than the width of said one of said end walls;

substantially all of the remaining portion of said negator spring being mounted in means in said follower when no cartridges are in said case;

said means for securing said negator spring comprising means defining a recess having an outer surface in the outer surface of one of said end walls adjacent said opening adjacent the top of said case;

means for defining an edge on said recess adjacent said opening adjacent the top of said case;

said edge having a thickness less than the thickness of said one end wall;

a substantially inverted U-shaped portion adjacent said one end of said negator spring;

said inverted U-shaped portion extending from inside said case, over said edge and in close proximity to said outer surface of said recess; and means integral with said case for securing the portion of said inverted U-shaped portion in close proximity to said outer surface of said recess to said case.

2. A cartridge clip as in claim 1 wherein said means for mounting said spring in said coiled relationship comprises:

means defining a transverse opening in said follower, said opening being adjacent said one of said side walls so that a portion of said negator spring extends out of said opening and said portion is located between said follower and said one of said end walls.

3. A cartridge clip as in claim 1 wherein said means integral with said case for securing a portion of said inverted U-shaped portion to said case comprises:

means for defining an opening in said inverted U-shaped portion adjacent one extremity thereof;

a projection integral with said case and extending from said case and passing through said opening in said inverted U-shaped portion; and said projection having an end portion having a diameter greater than the diameter of said opening in said inverted U-shaped portion to secure said inverted U-shaped portion to said case.

4. A cartridge clip as in claim 1 wherein:

said cartridges have a head and a rim; and said cartridges being located in said case with a portion of said rims in contact with portions of said negator spring.

5. A cartridge clip as in claim 4 and further comprising:

said rim of said cartridges has a diameter substantially equal to the width of said negator spring.

6. A cartridge clip as in claim 5 wherein:

said negator spring is metallic.

7. A cartridge clip as in claim 5 and further comprising:

means defining a longitudinally extending slot in one of said side walls of said case;

a projection on said follower extending through said slot so that said follower may be moved against the force of said spring so that cartridges can be inserted into said case.

8. A cartridge clip as in claim 7 wherein:

said case comprises a unitary molded structure.

9. A cartridge clip as in claim 8 wherein said means integral with said case for securing a portion of said inverted U-shaped portion to said case comprises:

means for defining an opening in said inverted U-shaped portion adjacent one extremity thereof;

a projection integral with said case and extending from said case and passing through said opening in said inverted U-shaped portion to secure said inverted U-shaped opening to said case; and said projection having an end portion having a diameter greater than the diameter of said opening in said inverted U-shaped portion to secure said inverted U-shaped portion to said case.

10. A cartridge clip as in claim 7 wherein said means for securing said negator spring comprises:

means for defining an edge on said one of said end walls adjacent said opening adjacent the top of said case;

means for defining an opening in said one of said end walls spaced from said edge, said end wall opening extending substantially parallel to said edge for substantially the full width of said one of said end walls;

a substantially inverted U-shaped portion adjacent said one end of said negator spring; and said inverted U-shaped portion extending from inside said case, over said edge, over a portion of said one of said end walls between said edge and said end wall opening and then into said end wall opening to a location adjacent said negator spring.

11. A cartridge clip as in claim 10 wherein:

said negator spring is metallic.

12. A cartridge clip comprising:

a case for storing cartridges having a pair of opposed longitudinally extending side walls and a pair of opposed longitudinally extending end walls;

said side walls having a width greater than said end walls;

an opening adjacent the top of said case through which cartridges may be moved;

a follower mounted for movement in said case and adapted to contact the lowermost cartridge in said case;

spring means for providing a force resisting movement of said follower into said case and for urging said follower in a direction out of said case as cartridges are loaded into and moved out of said case;

said spring means comprising a negator spring with the major portion thereof mounted in said follower in a coiled relationship when no cartridges are in said case;

means for securing said negator spring at one end thereof to one of said end walls;

said negator spring having a width slightly less than the width of said one of said end walls;

substantially all of the remaining portion of said negator spring being mounted in means in said follower when no cartridges are in said case;

means for defining an edge on said one of said end walls adjacent said opening adjacent the top of said case;

means for defining an opening in said one of said end walls spaced from said edge, said end wall opening extending substantially parallel to said edge for substantially the full width of said one of said end walls;

a substantially inverted U-shaped portion adjacent said one end of said negator spring; and said inverted U-shaped portion extending from inside said case, over said edge, over a portion of said one of said end walls between said edge and end wall opening and then into said end wall opening to a location adjacent said negator spring.

* * * * *